United States Patent [19]

Izenberg

[11] Patent Number: 5,044,103

[45] Date of Patent: Sep. 3, 1991

[54] SIGN HOLDER FOR SUSPENDED CEILINGS

[76] Inventor: Paul H. Izenberg, 1617 Morton, Ann Arbor, Mich. 48104

[21] Appl. No.: 512,432

[22] Filed: Apr. 19, 1990

Related U.S. Application Data

[63] Continuation-in-part of Ser. No. 421,974, Oct. 16, 1989.

[51] Int. Cl.[5] ..... G09F 7/22

[52] U.S. Cl. ..... 40/617; 40/611; 52/484

[58] Field of Search ..... 40/611, 615, 152, 152.1, 40/617, 553, 558; 52/311, 314, 316, 484

[56] References Cited

U.S. PATENT DOCUMENTS

| | | | |
|---|---|---|---|
| 291,215 | 1/1884 | Moneyment | 52/311 |
| 1,539,633 | 5/1925 | Benton et al. | 40/615 |
| 3,049,204 | 8/1962 | Sorenson | 52/484 |
| 3,352,071 | 11/1967 | Sutter | 52/484 |
| 4,528,764 | 7/1985 | Cobb | 40/558 X |
| 4,947,570 | 8/1990 | May et al. | 40/553 |

FOREIGN PATENT DOCUMENTS

| | | | |
|---|---|---|---|
| 0033182 | 8/1981 | Netherlands | 52/311 |

*Primary Examiner*—Kenneth J. Dorner
*Assistant Examiner*—J. Bonifanti
*Attorney, Agent, or Firm*—Harness, Dickey & Pierce

[57] ABSTRACT

A holder for a sign to be incorporated into a suspended ceiling having cross runners, main runners and ceiling panels. In particular, the holder has a perimeter supporting frame with a central aperture therein. The frame is suspended below the ceiling by downwardly extending arms. The arms terminate at their upper ends in generaly horizontal flanges which engage and rest upon corresponding horizontal surfaces of the main runners and cross runners of the suspended ceiling. A ceiling panel rests upon the flanges of the sign holder. So positioned, the ceiling panel and the support frame form a receiving space which permits the insertion of an informative or decorative sign.

8 Claims, 1 Drawing Sheet

SIGN HOLDER FOR SUSPENDED CEILINGS

CROSS REFERENCE TO RELATED APPLICATION

This application is a continuation-in-part of U.S. patent application Ser. No. 421,974, filed on Oct. 16, 1989.

BACKGROUND AND SUMMARY OF THE INVENTION

The present invention relates to a sign holder used in conjunction with a suspended ceiling. More particularly, the sign holder is of a type that is suspended below the grid support system of the suspended ceiling.

The drop or suspended ceiling has found widespread popularity in the construction of modern buildings. These buildings include not only the offices of the business and service industries, but also the family home having a basement converted into a recreational room. Such ceilings have gained popularity particularly because of their installation ease, low investment cost and overall appearance.

Suspended ceilings are generally constructed with some type of a grid support system. The grid system is composed of various types of support rails generally known as main runners, T-bars and perimeter rails. Rounding out the construction materials are suspension wires and ceiling panels or tiles.

Depending on the desired orientation of the ceiling panels, the main runners are aligned in the room in which the ceiling is to be installed. The main runners will generally extend the full length or width of the room. Suspension wires from the structural ceiling secure the support members in position. Extending transversely between the main runners are T-bars. The overall shape of the T-bars and main runners is the same, namely, an inverted "T" shape. Perimeter rails are used along the juncture of the ceiling and walls to facilitate attachment where the inverted "T" configuration would be inappropriate. The perimeter rails are of a general "L" configuration.

With the grid support system suspended in place, the ceiling panels are installed. The ceiling panels are supported by having their perimeter edges in contact with the aforementioned support members. Ceiling panels are generally constructed of an acoustically absorbent material and come in sizes to fit both standard grid support system sizes, four foot by two foot and two foot by two foot. The grid support system is generally oriented so that a minimum number of ceiling panels will have to be used during installation.

The sign holder of the present invention is desired so as to enable its incorporation into a suspended ceiling having standard size ceiling panels. However, the present invention is quite capable of being modified during production so as to adapt to future changes in standard ceiling panel size or shape.

The sign holder of the present invention has particular application where it is desirable to incorporate visually enhancing materials into the ceiling. Such materials might be of an informative or decorative nature. For example, samples of graphic art work might be placed in the ceiling of a graphic art design studio. Alternatively, a child's poster may be placed in a sign holder incorporated into the ceiling of a health care facility in an attempt to increase the psychological well being of a child unfortunately so found.

A sign holder of this general type is disclosed in U.S. patent application Ser. No. 421,974, filed on Oct. 16, 1989, filed by the Applicant of the present invention, and consists of a transparent face panel having upwardly extending support arms.

The present invention proves to increase cost efficiency by incorporating a perimeter supporting frame member having an aperture or central opening therein, thus reducing material costs. Support arms extend upward from the frame and terminate in outwardly extending finger portions which rest upon horizontal extensions of the support members of the grid support system. The support arms extend through the opening created by opposing members of the grid support system and allow the support frame to be suspended below the ceiling. Thus suspended, the upper surface of the frame member and the lowermost surface of a ceiling panel, located thereabove, define a receiving space which allows for the insertion of the decorative or informative sign. The central opening of the frame is such that an inserted sign will be supported along its perimeter in a manner similar to that of a ceiling panel in the grid support system. With this in mind, it is seen that the sign holder of the present invention works well with signs of a rigid or substantial construction, such as heavy weight paper or cardboard backing.

Additional benefits and advantages of the present invention will become apparent to those skilled in the art to which the invention relates from the subsequent description of the preferred embodiments and the appended claims, taken in conjunction with accompanying drawings.

DETAILED DESCRIPTION OF THE INVENTION

Figure 1:
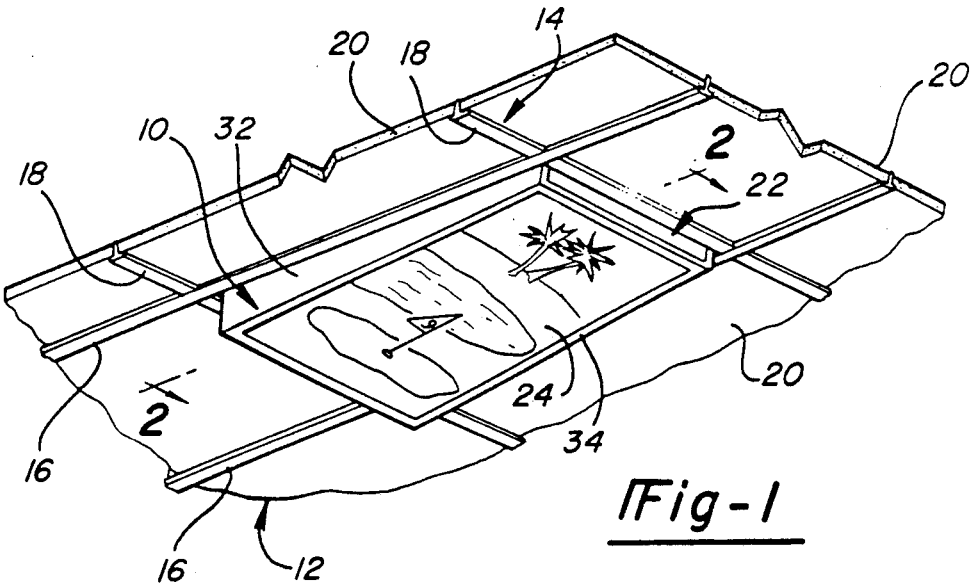
FIG. 1 is a perspective view of the sign holder of the present invention incorporated into a suspended ceiling, as viewed from below.

Now with reference to the drawings, in FIG. 1 a sign holder 10 is shown incorporated into a suspended ceiling 12. The sign holder 10 is supported by a grid support system 14 consisting of main runners 16, T-bars or cross runners 18, and numerous ceiling panels 20. Depending upon installation constraints, the main runners 16 may extend lengthwise or crosswise of the room. Generally, however, the main runners 16 are installed in a lengthwise orientation.

As seen in FIG. 1, the sign holder 10 is constructed to enable mounting directly below and analogous to a ceiling panel 20 of the suspended ceiling 12. One end of the sign holder 10 is open and defines an insertion opening 22 through which a sign 24 is received into the holder 10.

Figure 2:
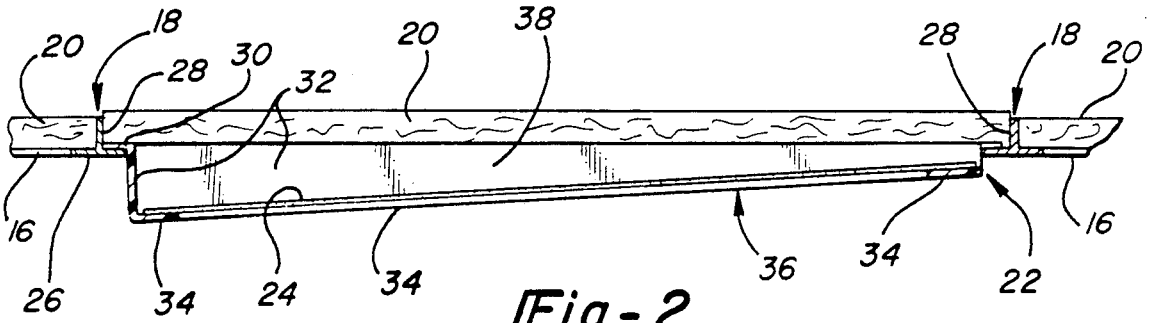
FIG. 2 is a cross-sectional view taken generally along the lines 2—2 in FIG. 1 showing the sign holder, a sign and the suspended ceiling.

Both the main runners 16 and the cross runners 18 have a generally inverted "T" cross-sectional shape. This is best seen in FIG. 2. The inverted "T" shape consists of a horizontally extending flange or lip 26 bisected by an upwardly extending portion 28. Guidewires (not shown) extend downward from the structural ceiling (not shown) of the room to the upward extending portions 28 and enable the suspended ceiling 12 to be "suspended" in place.

The sign holder 10 generally consists of opposing horizontal support flanges 30, a plurality of downwardly extending arms 32 and a sign supporting frame 34. The frame 34 of the holder 10 generally corresponds in shape to the ceiling panels 20 to further provide an aesthetically pleasing look to the ceiling 12.

The frame 34 is a perimeter supporting structure and defines an aperture or central viewing opening 36 through which an inserted sign 24 can be observed. In the present embodiment outermost dimensions of the frame 34 are somewhat less than the innermost dimensions, as defined by the horizontal flanges 26, of the opposing parallel support members, either main runners 16 or cross runners 18, of the grid support system 14. This allows the frame 34 to be extended through and between the opposing support members to a point somewhat below the grid support system.

The viewing opening 36 of the frame 34 is smaller than the size of the corresponding sign 24 it is designed to accept. Each member of the frame 34 defining the viewing opening 36 has a width substantial enough to provide a sufficient amount of perimeter support to maintain the sign 24 within the holder 10 and prevent it from "falling through" the opening 36 under its own weight. From this it is seen that the holder 10 works well when the paper stock used in the construction of the sign 24 is rigid enough to prevent the sign 24 from exhibiting a bowing tendency through the viewing opening 36. Heavy weight poster paper or cardboard backed signs are two examples which provide this rigidity.

Figure 3:
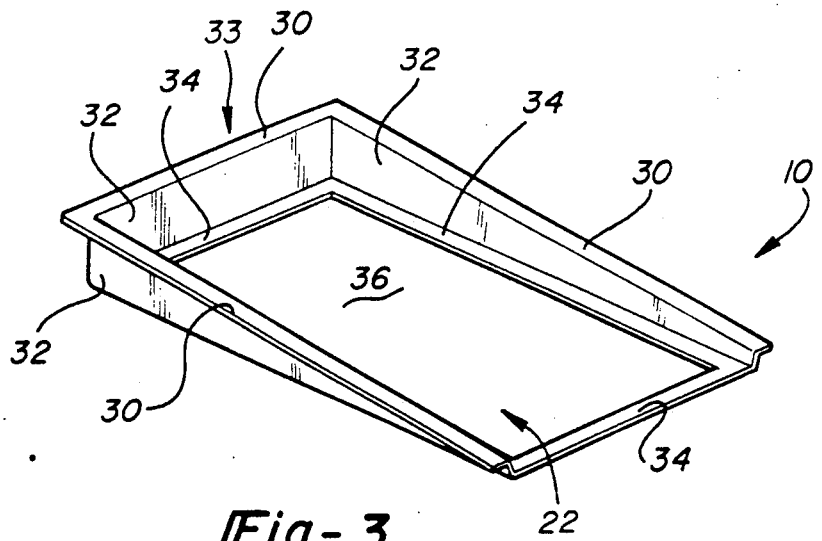
FIG. 3 is an perspective view of the sign holder as viewed from above.

Extending upward from the perimeter of the support frame 34 are a plurality of support arms 32. In the present embodiment, the arms 32 further define the outermost dimensions of the frame 34 and, likewise, extend between opposing parallel members of the grid support system 14. As best seen in FIG. 3, the present embodiment illustrates three arms 32, each extending the length of one side of the frame 34. While the arms 32 are each shown extending from the full length of a side of the frame 34, is readily seen that each arm 32 could be constructed as a number of individual arms 32 intermittently positioned along the frame 34. One side of the frame 34 is constructed without an arm 32 and defines the insertion opening 22 of the holder 10.

The arms 32 extending the longitudinal length of the holder 10 increase in height from the insertion opening 22 to an oppositely positioned closed end 33. In this manner, the frame 34 is inclined relative to the suspended ceiling 12 and promotes a more desirable viewing angle for the sign 24. The inclined position of the frame 34 provides for an increased ease of insertion, better retention of the sign 24 and further discourages any accidental release of the sign 24 from the holder 10. In an alternate embodiment the holder 10 could be parallel with the ceiling 12.

Each support arm 32 terminates in an outward, and generally, horizontal support flange 30. The flange 30 contacts and rests upon the upper surface of one lip 26 of the inverted "T" shape of either a main runner 16 or a cross runner 18. The width of the flange 30 corresponds to the width of the lip 26 extending outward from the upward portion 28. In this manner, the flanges 30 and the arms 32 hang or suspend the frame 34 below the lowermost surface of the ceiling 12. Once incorporated beneath the suspended ceiling 12, a receiving space 38 is defined between the ceiling panel 20 and the plane defined by the support frame 34.

While the present embodiment shows the frame 34 as being of a size to permit its extension through and between the opposing members of the grid support system 14, it is readily seen that the holder 10 may be constructed to permit only the arms 32 to extend between the opposing members of the grid support structure 14. In such a construction, the holder 10 would be "rocked" or "cocked" out of its normal position during installation or removal from below. The flanges 30 and arms 32 would then, as previously described, suspend the frame 34 below the ceiling 12.

The present invention is illustrated as being of a unitary construction. In the alternative, the elements may be fabricated individually and subsequently secured together by various known means including adhesives and fasteners. Because a lightweight construction is preferred, the sign holder 10 of the present invention is preferably constructed of a plastic. However, numerous lightweight sheet metals might also be used for construction materials, including aluminum and tin. The present invention might also incorporate a transparent face panel either inserted into the holder 10 before the sign 24 or formed integral with the holder 10.

While all the above description constitutes the preferred embodiment of the invention, it will be appreciated that the invention is susceptible to modification, variation and change without departing from the proper scope and fair meaning of the accompanying claims.

I claim:

1. A holder for a sign for incorporation into the grid support system of a suspended ceiling including a cross network of support structures having horizontal surfaces for supporting rectangularly shaped ceiling panels positioned thereupon, said holder comprising:

a perimeter support frame for supporting the sign about its perimeter in a resting engagement thereon and defining an aperture centrally therein allowing the sign to be viewed through said aperture, said frame also having upwardly extending arms whereby when in place said arms closely fit inside of laterally separated elements of the ceiling support structure, said frame also having laterally extending support flanges projecting from said arms along at least two sides of said frame, one side of said frame having a laterally facing opening being open to permit the insertion of the sign into said holder and removal therefrom, whereby said laterally extending support flanges engage the horizontal surfaces of the grid support system for supporting said frame and said opening below one of said ceiling panels in a substantially planar orientation to display the sign in a corresponding substantially planar orientation.

2. A holder for a sign as set forth in claim 1 wherein said support arms are integrally formed with the frame and constructed of thermoplastic resin.

3. A holder for a sign as set forth in claim 1 wherein said flanges are generally in register with the perimeter of the ceiling panel positioned thereabove.

4. A holder for a sign as set forth in claim 1 wherein said support arms upwardly extend from three sides of said frame.

5. A holder for a sign as set forth in claim 1 wherein said support arms extend the length of said sides.

6. A holder for a sign as set forth in claim 1 wherein said frame is supported below the ceiling in a skewed planar orientation.

7. A unitary holder for a sign for incorporation into a room having a suspended ceiling consisting of ceiling panels having a rectangular shape and being suspended by a grid support system composed of a crossed network of support structures having horizontally extending support surfaces for supporting the rectangular ceiling panels around their perimeter, said unitary holder comprising:

a support frame for supporting said sign along its perimeter and defining a central aperture therethrough for viewing said sign supported therein, said frame being of a rectangular shape generally corresponding to the ceiling panel shape; and a plurality of support arms upwardly extending from said frame and terminating in outwardly extending support flanges, at least one pair of said arms extending upwardly from opposing perimeter edges of said frame, whereby when in place said arms being constructed so as to position said arms in close fit between the support structure and said outwardly extending support flanges corresponding with the horizontal surfaces of the support structures and resting thereupon to fixably suspend said frame below the ceiling in a substantially planar orientation skewed from horizontal, said frame also having portions defining a laterally facing receiving opening being positioned below the grid support system for the insertion of the sign into said frame and removal therefrom.

8. A holder for a sign as set forth in claim 7 wherein said sign holder is constructed of a thermoplastic resin.

* * * * *